US005304095A

United States Patent [19]

Morris

[11] Patent Number: 5,304,095

[45] Date of Patent: Apr. 19, 1994

[54] ROOF VENTILATOR HAVING LONGITUDINALLY ALIGNED FOLDING SECTIONS

[75] Inventor: Richard J. Morris, Prior Lake, Minn.

[73] Assignee: Liberty Diversified Industries, Inc., New Hope, Minn.

[21] Appl. No.: 126,371

[22] Filed: Sep. 24, 1993

[51] Int. Cl.[5] ..... F24F 7/02

[52] U.S. Cl. ..... 454/365; 52/57; 52/199

[58] Field of Search ..... 52/57, 199; 454/364, 454/365, 366, 367

[56] References Cited

U.S. PATENT DOCUMENTS 4,803,813 2/1989 Fiferman ..... 454/365 X
4,876,950 10/1989 Rudeen ..... 454/365
5,002,816 3/1991 Hofmann et al. ..... 52/57 X
5,094,041 3/1992 Kasner et al. ..... 454/365 X

*Primary Examiner*—Harold Joyce
*Attorney, Agent, or Firm*—Briggs & Morgan

[57] ABSTRACT

A ridge cap type roof ventilator comprising a plurality of sections aligned longitudinally with one another and hingedly interconnected along their confronting ends such that the plurality of sections may be folded or pivoted into parallel abutting contact. Once folded, several roof ventilators may be stacked with their vent parts in an overlapping, interfitted pattern to provide a stable column or stack having a minimal volume to conserve the space required to store or ship a predetermined number of the roof ventilators. The sections may be unfolded for positioning and installation on the ridge of the roof.

6 Claims, 4 Drawing Sheets

ROOF VENTILATOR HAVING LONGITUDINALLY ALIGNED FOLDING SECTIONS

BACKGROUND OF THE INVENTION

This invention relates generally to roof ventilators, and particularly to a corrugated plastic ridge cap type roof ventilator having interconnected segments which may be folded longitudinally for storage, shipping, and installation.

Embodiments of a foldable corrugated plastic ridge cap roof ventilator have previously been disclosed in U.S. Pat. Nos. 4,803,813 to Fiterman and 5,094,041 to Kasner, the content of those patents (including the related applications, documents, and references) being incorporated herein by reference as though fully set forth. The details and description of the fabrication, assembly, and use of the roof ventilators shown in the Fiterman '813 and Kasner '041 patents should be assumed to apply in all pertinent respects to the roof ventilator discussed herein, with the exception of the particular variations and modifications set forth and described with particularity.

The improvement disclosed herein is equally applicable to and may be incorporated into many other types of ridge cap type roof ventilators, with representative examples being shown for demonstrative purposes only by U.S. Pat. Nos. 3,949,657; 4,843,953; and 5,054,254 to Sells; 4,942,699 to Spinelli; 2,579,662 to Gibson; or 4,876,950 to Rudeen.

These examples show ridge cap type roof ventilators that are installed in short sections aligned end-to-end along the ridge of a roof in covering relation to a ventilation opening. The installer will remove several sections from the shipping carton, pallet, or vehicle and carry those sections to the roof, fasten a first section in position on the ridge of the roof, and then place additional sections in abutting contact with one or both ends of the first sections and progress sequentially along the ridge of the roof fastening the sections to the roof. Once the line of roof ventilators is installed, they are overlaid with shingles, tar paper, tile, or other roofing materials.

BRIEF SUMMARY OF THE INVENTION

It is therefore one object of this invention to design an improved roof ventilator which permits more efficient storage and shipping of ridge cap roof ventilators, and reduces the time and effort required to install extended sections of ridge cap roof ventilators.

It is an additional object of this invention to design the above roof ventilator such that several sections may be quickly installed with greater accuracy and forming a straighter line along the ridge of the roof.

It is yet an another object of this invention to design the above roof ventilator such that when a line of roof ventilators are installed along the ridge of a roof, they will present less openings or gaps which must be covered, blocked, or which might permit moisture to leak.

Briefly described, the ridge cap type roof ventilator of this invention comprises a plurality of sections aligned longitudinally with one another and hingedly interconnected along their confronting ends such that the plurality of sections may be folded or pivoted into parallel abutting contact. Once folded, several roof ventilators may be stacked with their vent parts in an overlapping, interfitted pattern to provide a stable column or stack having a minimal volume to conserve the space required to store or ship a predetermined number of the roof ventilators. The sections may be unfolded for positioning and installation on the ridge of the roof.

DESCRIPTION OF THE PREFERRED EMBODIMENTS

Figure 1:
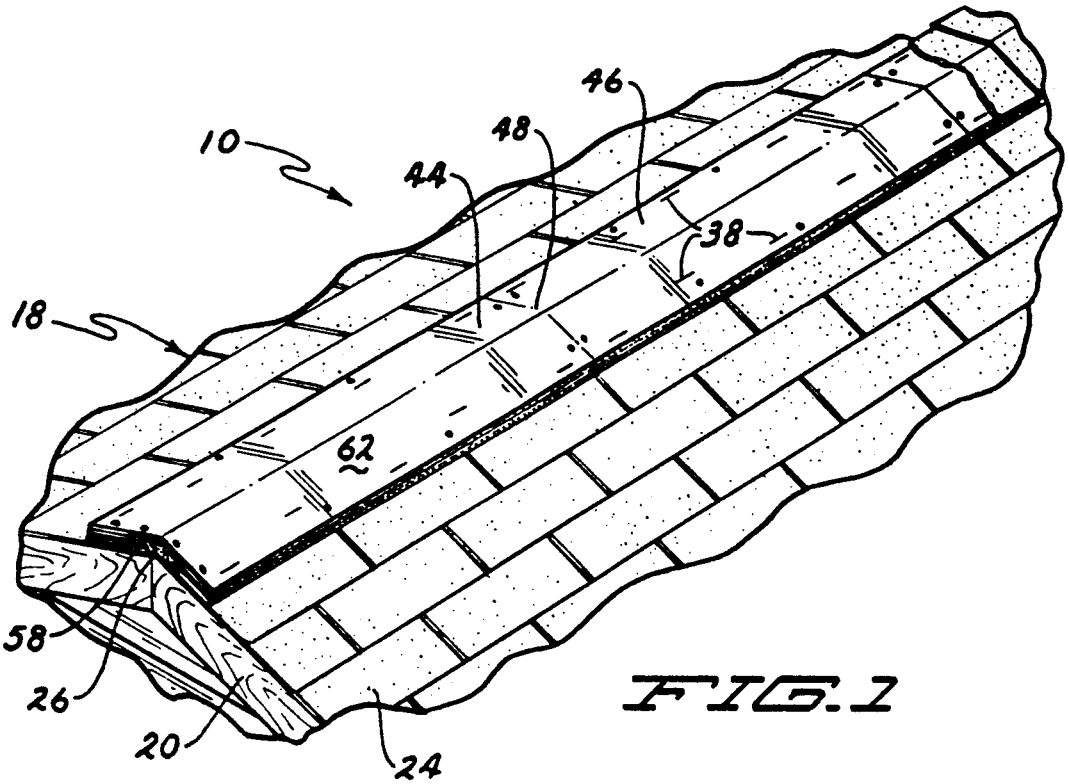
FIG. 1 is a perspective view of the roof ventilator of this invention installed on a roof showing a plurality of sections aligned longitudinally with one another.

The roof ventilator of this invention is shown in FIGS. 1–10 and referenced generally therein by the numeral 10.

The foldable corrugated plastic roof ventilators as disclosed in U.S. Pat. Nos. 4,803,813 to Fiterman and 5,094,041 to Kasner are basic to the design of the roof ventilator 10, and the terminology utilized in those patents is generally adopted herein.

The roof ventilator 10 comprises a pair of ventilator sections 12, 14 disposed over an open cutout 16 in the roof 18. The roof 18 is generally comprised of a plurality of angled joists, trestles, and beams 20 covered with overlays of plywood 22 and shingles 24, respectively, and together form a central peak or ridge 26.

Figure 8:
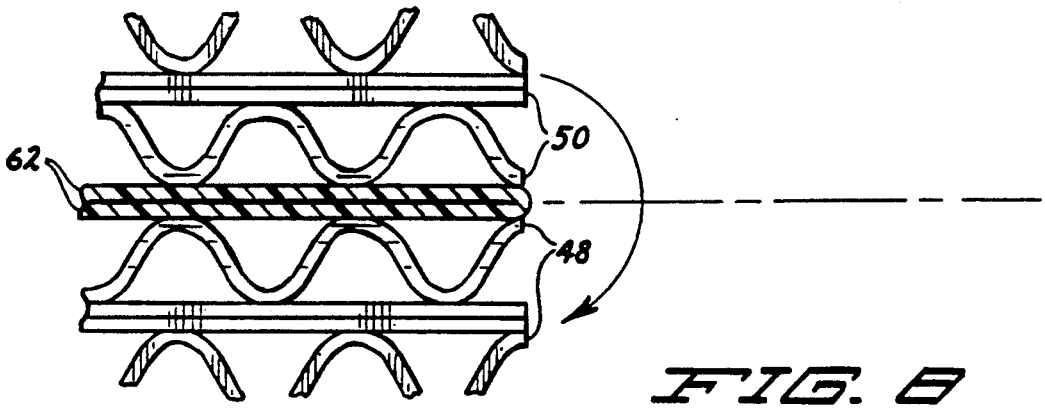
FIG. 8 is a partially broken away cross sectional view of the roof ventilator of FIG. 1 taken through line 8—8 of FIG. 2 showing the plurality of sections folded or pivoted across the hinged interconnection into parallel abutting contact with one another.
Figure 9:
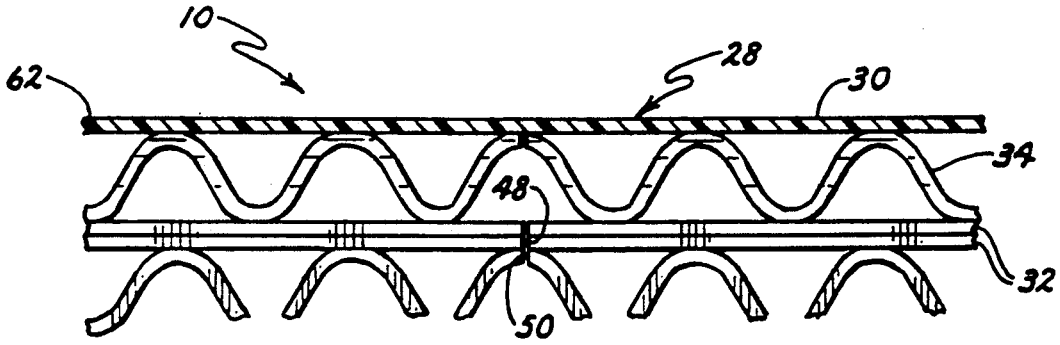
FIG. 9 is a partially broken away cross sectional view of the roof ventilator of FIG. 1 showing the plurality of sections aligned longitudinally end-to-end with one another.
Figure 10:
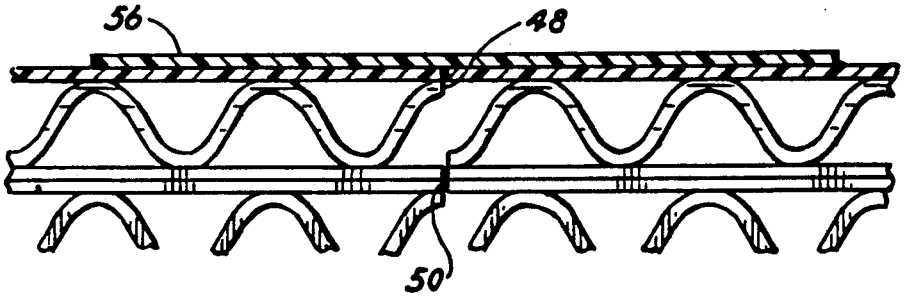
FIG. 10 is a partially broken away cross sectional view of an alternate embodiment of the roof ventilator of FIG. 1 showing the plurality of sections aligned longitudinally end-to-end with one another.

The roof ventilator 10 is fabricated from a generally flat or planar section of double-faced corrugated plastic sheet material 28 such as polyethylene, preferably black in color. Referring to FIGS. 8–10, it may be seen that the double-faced corrugated plastic sheet material 28 includes a pair of generally planar spaced-apart liners or plies 30, 32 which are connected by a corrugated or convoluted intermediate ply 34 having a multiplicity of convolutions forming parallel aligned air spaces or partially enclosed channels defining a longitudinal grain to the double-faced corrugated plastic sheet material 28. In some embodiments, the double-faced corrugated plastic sheet material 28 may take on the configuration of a pair of parallel planar plies 30, 32 with a multiplicity of generally perpendicular connecting beams (not shown), due to the particular molding process involved in making the double-faced corrugated plastic sheet material 28 and the tendency of the corrugated intermediate ply to melt together with the planar plies 30, 32.

The vent parts 12, 14 are connected by a flexible or bendable top panel 62 similarly fabricated from a corrugated plastic sheet material 28, and having an arcuate center routing 36 as described in the Kasner '041 patent to facilitate bending or forming of the top panel 62 to the pitch of the roof 18.

The vent parts 12, 14 of the roof ventilator 10 may be fabricated from pleated or hingedly interconnected rectangular panels having equal or progressive widths using either a "slit-scored" or "nick-scored" technique as discussed in the Fiterman '813 and Kasner '041 patents, however in this embodiment a stacked assembly technique in which a plurality of equal width and length panels are placed in parallel and aligned stacked relationship with one another and fastened together and to the top panel 62 using a plurality of fasteners 38 such as staples to form each of the vent parts 12, 14 with uniform and non-tapered inner and outer edges 40, 42, respectively, that are generally perpendicular to the plane of the corresponding portion of the top panel 24.

Figure 2:
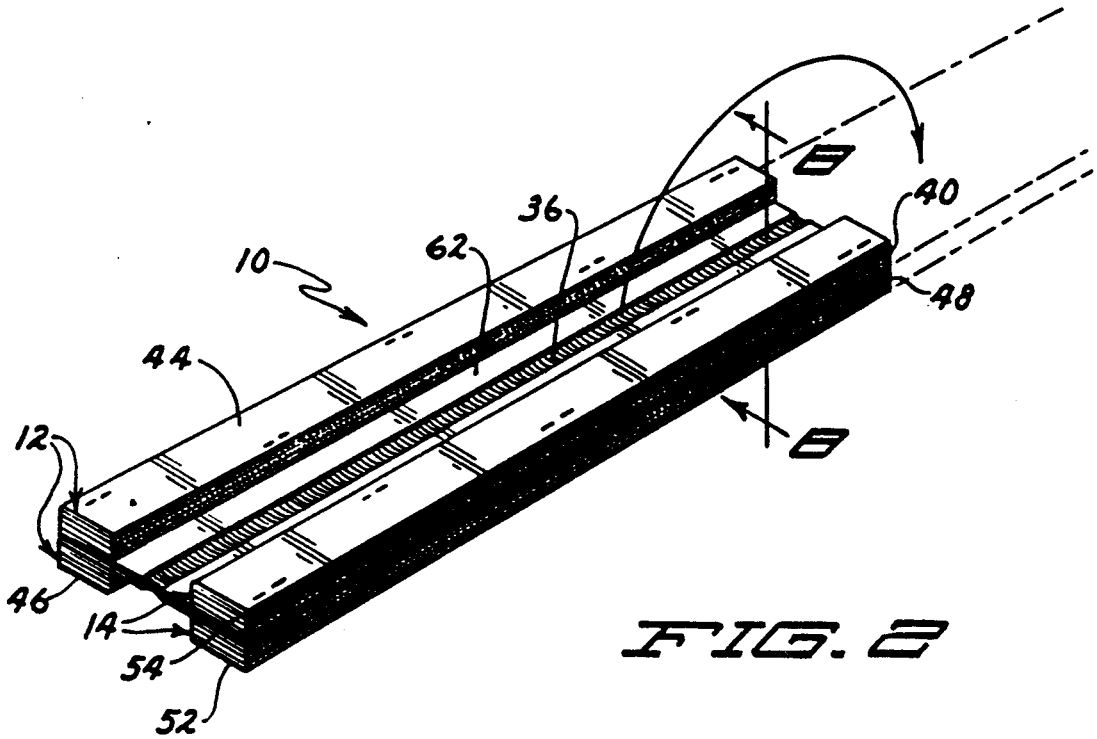
FIG. 2 is a perspective view of the roof ventilator of FIG. 1 in the folded position with the plurality of sections folded or pivoted across the hinged interconnection into parallel abutting contact with one another.

Each roof ventilator is constructed from a plurality of sections 44, 46 aligned longitudinally with one another and hingedly interconnected along a common border or hingeline 48. Each section 44, 46 includes two vent parts 12, 14 that are generally separated from the two vent parts 12, 14 of the corresponding sections, 46, 44 respectively, with the adjacent or closely proximate ends 48, 50 of the vent parts 12, 14 of the sections 44, 46 generally confronting one another in parallel abutting contact when the sections 44, 46 are aligned longitudinally with one another as shown in FIGS. 1, 9 and 10. The hingeline 48 extends across the top panel 62 generally perpendicular to the longitudinal axis of the roof ventilator 10, with each section 44, 46 having approximately the same length such that the terminal ends 52, 54 of the sections 44, 46 are generally aligned with one another when the sections 44, 46 are folded or pivoted across the hingeline 48 with the corresponding portions of the top panel 62 of each section 44, 46 in parallel abutting contact with one anther as shown in FIGS. 2 and 8. It is anticipated that the preferred lengths of the sections 44, 46 will conform to uniform building units, such as 4', 6', 8', and so forth, so that each roof ventilator 10 will have an extended or unfolded length of 8', 12', 16', and so forth, with one section 44, 46 being cut to fit non-standard dimensions as necessary.

Referring to FIGS. 8–10, it may be seen that the hingeline 48 may be fabricated in alternate embodiments. Referring particularly to FIGS. 8 and 9, the top planar ply 30 of the top panel 62 may remain intact and form the hingeline 48 between the sections 44, 46, with the remaining panels of the vent parts 12, 14 being cut completely therethrough along with the lower planar ply 32 and intermediate ply 34 of the top panel 62. Alternately, the vent parts 12, 14 may be formed separately or cut completely therethrough along the hingeline 48, with the top panel 62 remaining uncut but being scored parallel with the grain of the top panel 62 to form the foldable hingeline 48. Referring particularly to FIG. 10, the vent parts 12, 14 may be formed separately or cut completely therethrough along the hingeline 48, with the plurality of sections 44, 46 being hingedly interconnected using a flexible, foldable connector 56 such as adhesive tape that is fixedly attached to the top panel 62 and extends between the sections 44, 46 across the hingeline 48 to form the foldable hingeline 48.

Figure 3:
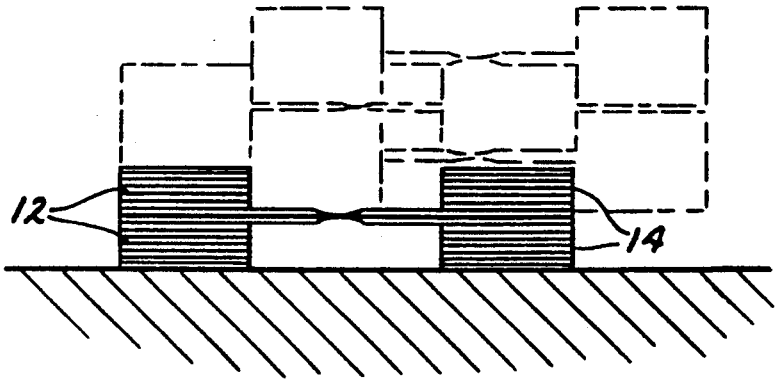
FIG. 3 is an end elevation view of several of the roof ventilators of FIG. 1 stacked in the overlapping, interfitted pattern with one another.
Figure 4:
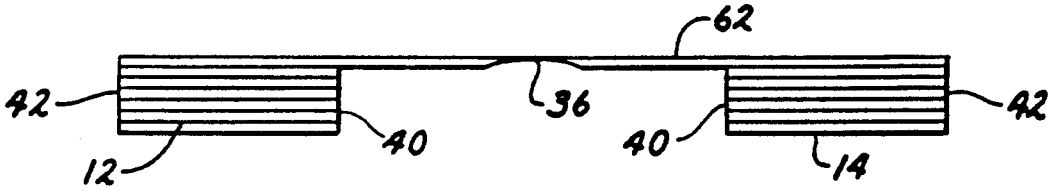
FIG. 4 is an end elevation view of some of the roof ventilators of FIG. 1.
Figure 5:
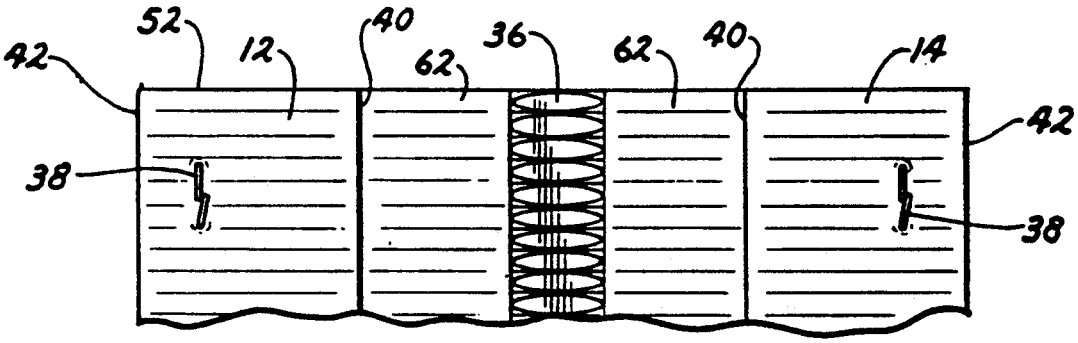
FIG. 5 is a partially broken away bottom view of the terminal end of one of the roof ventilators of FIG. 1.
Figure 6:
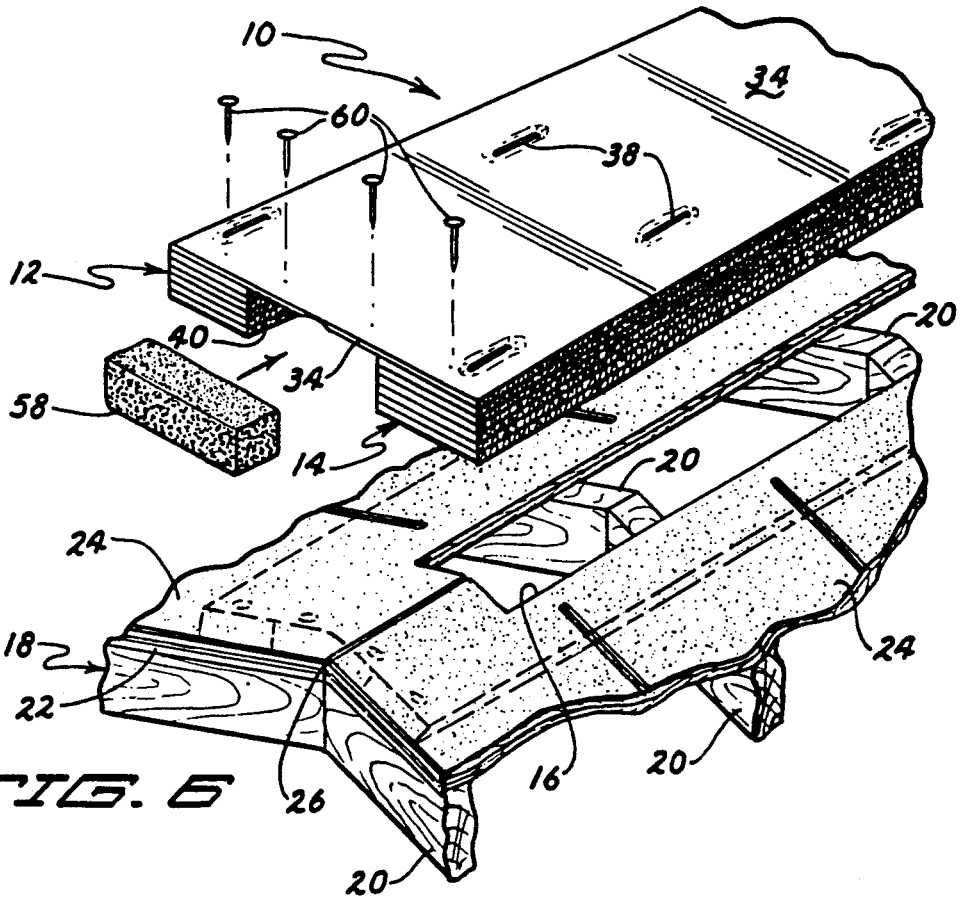
FIG. 6 is a partially broken away perspective view of a roof ventilator of FIG. 1 disposed above the peak of a roof for installation thereon.
Figure 7:
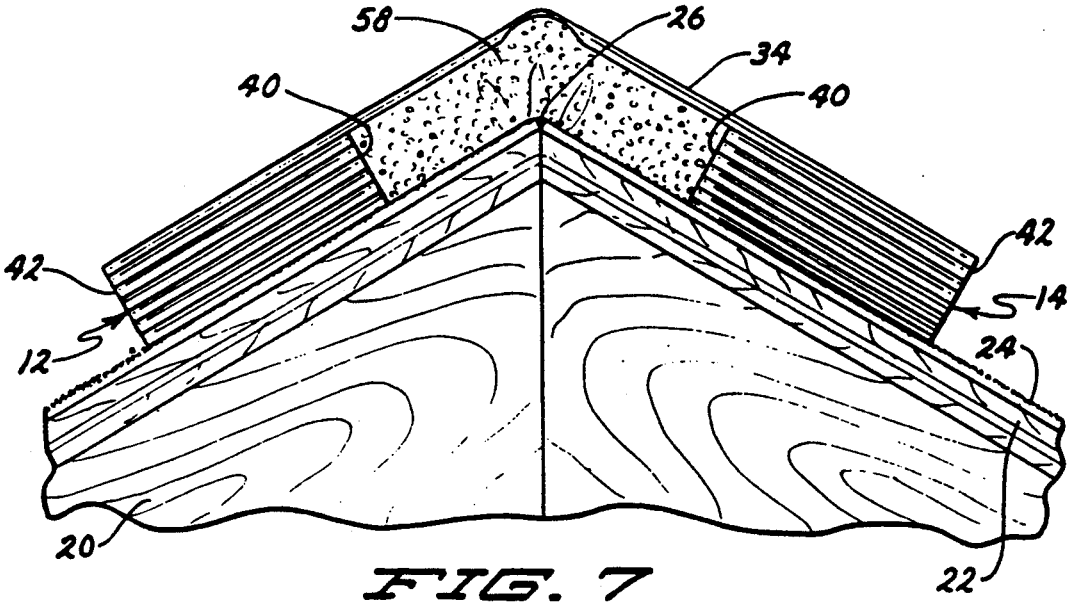
FIG. 7 is a broken away end view of the roof ventilator of FIG. 1 in an installed position.

Referring to FIG. 3, it may be seen that several of the roof ventilators 10 may be folded as shown in FIG. 2, and then stacked in an overlapping, interfitted pattern. The overlapping, interfitted pattern may take one of two forms. First, the vent parts 12, 14 of one section 44, 46 of one roof ventilator 10 are disposed between the vent parts 12, 14 of a section 44, 46 of another roof ventilator 10 as shown in FIG. 3 to provide a stable column or stack having a minimal volume to conserve the space required to store or ship a predetermined number of the roof ventilators. Second, if the combined widths of the corresponding vent parts 12, 14 is less than the distance between the inner edges 40 of the vent parts 12, 14 of a section 44, the roof ventilators 10 may be stacked such that one vent part 12 or 14 of one section 44 or 46 of one roof ventilator 10 is disposed between the corresponding vent parts 12, 14 of different sections 44 of two other roof ventilators 10, so that the space between the four vent parts 12, 14 of one roof ventilator 10 may receive the vent parts 12, 14 of up to four other roof ventilators, with this latter stacking configuration continuing horizontally in a continuous chain to the extent of any carton, pallet, or vehicle bed in or on which the roof ventilators 10 are stacked.

In operation, an installer will remove one or more roof ventilators 10 from their stacked configuration and carried to the roof 18. The first roof ventilator 10 is placed on the roof 18 adjacent to or covering the opening 16 with the terminal end 52 of the "bottom" section 44 at a predetermined location where the line of roof ventilators 10 begins. The "top" section 46 is pivoted upwardly away from the "bottom" section 44 across the hingeline 48 and then downwardly until the sections 44, 46 are generally aligned, with the top panel 62 bending until the vent parts 12, 14 are parallel with and contact the roof 18 on opposing sides of the opening. A foam end closure 58 having a length equal to the distance between the confronting inner edges 40 of the vent parts 12, 14 and height equal to or slightly greater than the height of the vent parts 12, 14 measured between the shingles 24 and top panel 62 is inserted into the gap between the vent parts 12, 14 adjacent to the terminal end 52 and beneath the top panel 62, and the roof ventilator 10 then secured to the roof 18 using fasteners 60 such as nails. The end closure 58 may be adhered to the roof ventilator 10 or roof 18 or both, and the nails or fasteners 60 will penetrate the top panel 62, end closure 58, and any adhesive.

While the preferred embodiment of the above roof ventilator 10 has been described in detail above with reference to the attached drawing Figures, it is understood that various changes and adaptations may be made in the roof ventilator 10 without departing from the spirit and scope of the appended claims.

What is claimed is:

1. A roof ventilator for mounting on a peak of a roof having a roof opening, said roof ventilator having a plurality of vent parts each defining a multiplicity of air passages communicating with said roof opening, said roof ventilator comprising:

a first section, said first section having a first top panel and a first pair of vent parts; and a second section, said second section having a second top panel and a second pair of vent parts, said first section being hingedly interconnected to said second section along a hingeline such that said first section and said second section may be pivoted to a folded position whereat said first top panel and said second top panel are in generally parallel relation to one another, and to an unfolded position whereat said first section and said section are generally longitudinally aligned with one another, wherein the first pair of vent parts being each disposed on opposing sides of the opening and the second pair of vent parts being each disposed on opposing sides of the opening when the first section and the second section are generally aligned with one another in the unfolded position.

2. The roof ventilator of claim 1 wherein the first top panel and the second top panel are each fabricated from a generally planar sheet material.

3. The roof ventilator of claim 2 wherein the generally planar sheet material is double-faced corrugated plastic having a pair of generally planar plies and a convoluted intermediate ply, at least a portion of the generally planar sheet material forming the hingeline.

4. The roof ventilator of claim 3 wherein the portion of the generally planar sheet material forming the hingeline includes at least one of the pair of generally planar plies.

5. The roof ventilator of claim 1 wherein the hingeline is fabricated from an adhesive tape material attached to and extending between the first top panel and the second top panel.

6. The roof ventilator of claim 1 wherein the roof ventilator may be stacked with one or more like roof ventilators with their plurality of vent parts disposed in an overlapping, interfitted pattern, whereby the roof ventilator and the like roof ventilators form a stable column.

* * * * *